United States Patent [19]

Mangus

[11] 3,972,660

[45] Aug. 3, 1976

[54] CORNER SEALS FOR ROTARY MECHANISMS

[75] Inventor: Ervin E. Mangus, Brimfield, Ill.

[73] Assignee: Caterpillar Tractor Co., Peoria, Ill.

[22] Filed: Nov. 12, 1975

[21] Appl. No.: 631,018

[52] U.S. Cl. ..... 418/121; 418/142

[51] Int. Cl.[2] ..... F01C 19/04

[58] Field of Search ..... 418/120, 121, 142; 277/81 P

[56] References Cited

UNITED STATES PATENTS

| | | | |
|---|---|---|---|
| 3,263,912 | 8/1966 | Frenzel | 418/121 |
| 3,485,217 | 12/1969 | Irgens | 418/121 |
| 3,829,259 | 8/1974 | Baynes | 418/121 |
| 3,930,767 | 1/1976 | Hart | 418/142 |

*Primary Examiner*—Robert I. Smith

*Attorney, Agent, or Firm*—Wegner, Stellman, McCord, Wiles & Wood

[57] ABSTRACT

An improved corner seal for rotary mechanisms, such as trochoidal or slant axis rotary mechanisms. A rotor is provided with a piston seal receiving bore and the piston seal is received in the bore to be carried by the rotor and sealingly engage a wall of the mechanism operating chamber. A first seal receiving groove is disposed in the rotor and intersects the bore and a correspondingly dimensioned first seal receiving groove is located in the piston seal to be substantially centered with the first groove in the rotor. A first seal is received in the grooves. A second seal receiving groove is located in the rotor and intersects the bore at an angle to the first seal receiving groove. A second seal receiving groove is disposed in the piston seal and is only nominally centered with the second seal receiving groove in the rotor. It is also substantially wider than the second seal receiving groove in the rotor. A second seal is received in the second seal receiving grooves and a further seal is disposed in the second seal receiving groove in the piston seal on one side of the second seal.

4 Claims, 4 Drawing Figures

CORNER SEALS FOR ROTARY MECHANISMS

BACKGROUND OF THE INVENTION

This invention relates to rotary mechanisms, such as pumps, compressors, engines, or the like, and, more specifically, to corner seals employed in such mechanisms.

Conventional corner seals in trochoidal engines and slant axis rotary engines are expensive to manufacture. Typically, the corner seals include so-called "piston seals" (sometimes termed bolts) which are disposed at the intersection of apex seals and end seals in trochoidal type mechanisms or peripheral seals in slant axis rotary mechanisms. Typically, the piston seals are provided with at least two grooves, one for receipt of the apex seal and one more for receipt of the end or peripheral seal. To achieve adequate sealing, the centerline of the grooves in the piston seal must accurately align with the corresponding seal receiving grooves in the rotor and such centerlines preferably should coincide with the center of the piston seal.

Since the design or typical clearance between seals and the sides of the grooves is normally on the order of 0.08 mm, tolerances must be held quite close to prevent excessive leakage. As a consequence, manufacturing cost is undesirably high.

SUMMARY OF THE INVENTION

It is the principal object of the invention to provide a new and improved rotary mechanism. More specifically, it is an object of the invention to provide a new and improved corner seal configuration for use in such mechanisms.

An exemplary embodiment of the invention achieves the foregoing object in a rotary mechanism having a housing defining an operating chamber and a rotor movable within the chamber. A piston seal receiving bore is placed in the rotor and a piston seal is received in the bore to be carried by the rotor and to sealingly engage a wall of the operating chamber. A first seal receiving groove is disposed in the rotor and intersects the bore. A correspondingly dimensioned first seal receiving groove is also located in the piston seal and is substantially centered with respect to the first seal receiving groove in the rotor. A first seal is received in the first seal receiving grooves.

A second seal receiving groove is located in the rotor and intersects the bore at an angle to the first seal receiving groove. A second seal receiving groove is located in the piston seal and is only nominally centered and substantially wider than the second seal receiving groove in the rotor. A second seal is disposed in the second seal receiving grooves.

A further seal is received in the second seal receiving groove in the piston seal on one side thereof to seal the gap due to the increased width of that groove. The wider groove allows simple fabrication at minimum expense and the provision of the further seal prevents excessive leakage by reason of the construction.

If the rotary mechanism is a trochoidal type mechanism, one such further seal need be employed while, if the mechanism is a slant axis rotary mechanism, two such further seals will be employed, one on each side of the second seal.

Preferably, the first seal will be an apex seal, while the second seal will be an end seal if the mechanism is a trochoidal mechanism or a peripheral seal if the mechanism is a slant axis rotary mechanism.

Spring means are employed for biasing the various seals into good sealing engagement with the walls of the housing chamber.

Other objects and advantages will become apparent from the following specification taken in conjunction with the accompanying drawings.

DESCRIPTION OF THE PREFERRED EMBODIMENT

Figure 1:
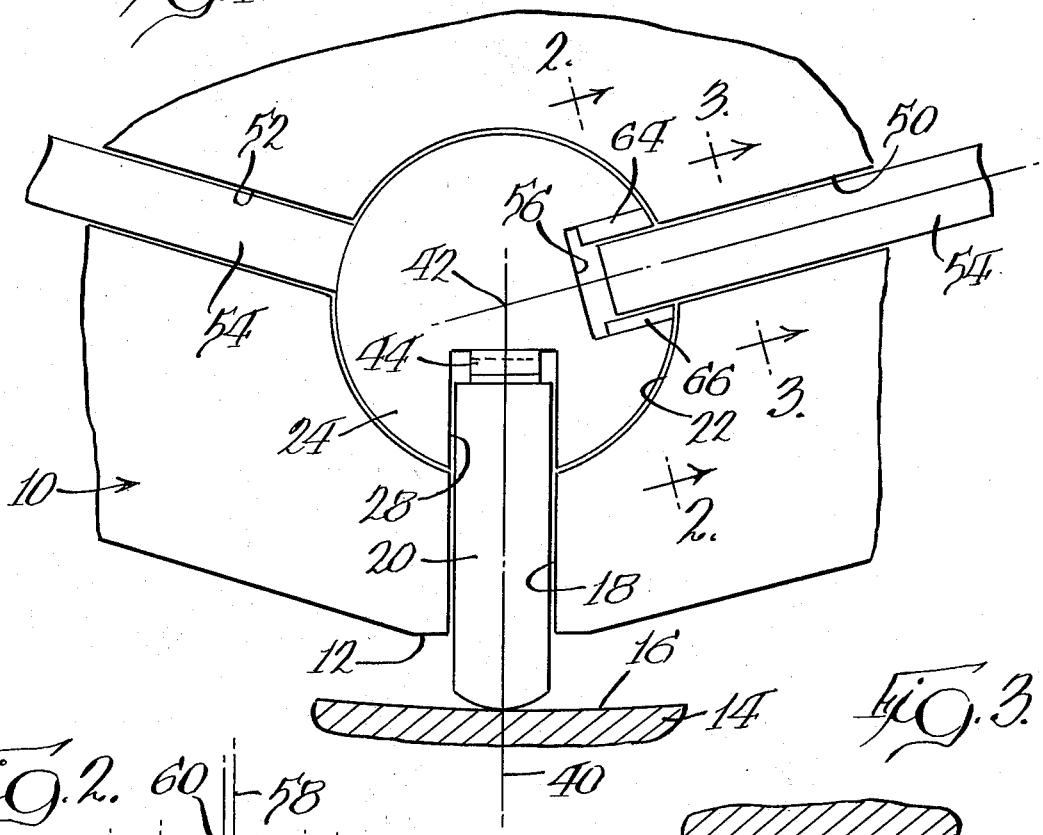
FIG. 1 is a fragmentary view of a corner seal made according to the invention employed in a slant axis rotary mechanism.

The drawings illustrate a rotary mechanism embodying a corner seal made according to the invention. A seen in FIG. 1, the rotary mechanism is in the form of a slant axis rotary mechanism, but it is to be understood that the invention will find applicability in other forms of rotary mechanisms as, for example, trochoidal mechanisms. The mechanism includes a rotor having a flange, generally designated 10, provided with plural apices 12 (only one of which is shown). The mechanism also includes a housing 14 with a pair of opposed side walls 16 (only one of which is shown).

At each apex 12, the rotor flange 10 includes a groove 18 which receives an apex seal 20. The apex seal 20 sealingly engages the end wall 16. As illustrated, the seal 20 is slightly narrower than the groove 18 to provide for gas energization.

Figure 2:
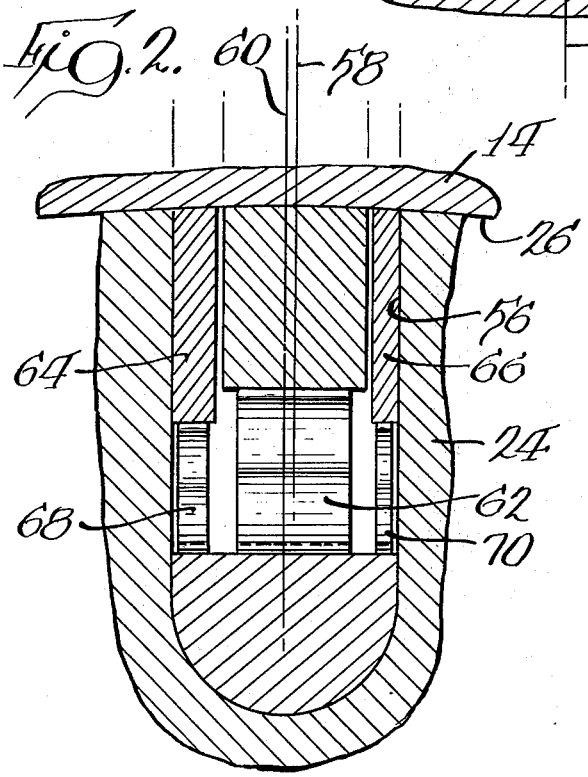
FIG. 2 is an enlarged, sectional view taken approximately along the line 2—2 of FIG. 1.
Figure 3:
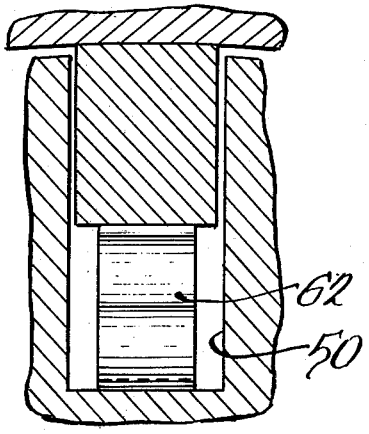
FIG. 3 is a sectional view taken approximately along the line 3—3 of FIG. 1.

At each apex 12 there is provided a bore 22 which intersects the groove 18. The bore 22 receives a piston seal 24 (sometimes termed a bolt) which, as seen in FIG. 2, sealingly engages the radially outer spherical surface 26 of the housing 14.

The piston seal 24 also includes a seal receiving groove 28 for receipt of the apex seal 20. The groove 28 has the same width as the groove 18 and is substantially centered with the groove 18. That is, both the grooves 18 and 28 are machined to have the centerline 40 and, in fact, will have the same centerline save for deviations due to the usual tolerances in manufacturing.

In general, the centerline 40 will pass through the center 42 of the piston seal 24.

Undulating spring 44 is disposed in the groove 28 and will extend through the groove 18 to bias the seal 20 into sealing engagement with the surface 16.

The radially outer surface of the rotor flange 10 is provided with grooves 50 and 52 for receipt of peripheral seals 54. Each of the grooves 50 and 52 intersects the bore 22 and one end of each peripheral seal 54 will abut a side of the piston seal 24, as illustrated at the left in FIG. 1. The opposite end of each seal 54 will be received in a groove 56 in the piston seal 24. As best seen in FIG. 2, the seal receiving groove 56 is only nominally centered with respect to the groove 50. Specifically, the centerline of the groove 50 is illustrated at 58, while the centerline of the groove 56 is illustrated at 60.

It will also be noted from FIG. 1 that the groove 56 is considerably wider than the groove 50.

An undulating biasing spring 62 extends through the groove 50 and into the groove 56 to bias the peripheral seal 54 into good sealing engagement with the radially outer spherical surface 26.

As seen in FIGS. 1 and 2, the groove 56 receives further sealing elements 64 and 66 respectively. The seals 64 and 66 are disposed on opposite sides of the peripheral seal 54 within the groove 56 and are biased by springs 68 and 70, respectively, into sealing engagement with the outer spherical wall 26.

Figure 4:
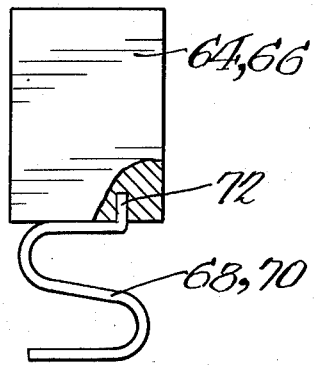
FIG. 4 is an elevational view of a seal employed in the invention with parts broken away for clarity.

As seen in FIG. 4, the spring 68 or 70 may be generally S-shaped and provided with a tongue 72 on one end for receipt within the corresponding seal to establish a unitized seal assembly consisting of the seal and the spring for ease of insertion during assembly of the mechanism.

Because no great effort is made to align the centerline 58 of the groove 50 with the centerline 60 of the groove 56, relatively loose tolerance standards may be employed so as to minimize machining expense. By forming the groove 56 to be considerably wider than the groove 50, considerable misalignment may be tolerated. While such misalignment would normally cause the existence of a leakage path of considerable size, the presence of the seals 66 and 64 eliminate the leakage path. As a consequence, good sealing is retained while fabrication costs are minimized.

In general, in order to facilitate handling, it is desirable that the seals 64 and 66 be relatively thick as, for example, on the order of 2 or 3 mm. They may be machined in thickness steps of 0.025 mm to provide a fine adjustment for side clearance and excellent control over gas leakage. Thus, having a variety of the seals 64 and 66 available, upon assembly, it is only necessary to measure the spacing between the end of the peripheral seal 54 and the sides of the groove 56 and select an appropriately sized seal 64 or 66 for insertion.

While the invention has been described in connection with a slant axis rotary mechanism, it will be understood that the same will find use in other rotary mechanisms, such as a trochoidal mechanism. In such a case, it frequently will not be necessary to employ both of the seals 64 and 66 in connection with the end seals of such mechanisms (end seals in trochoidal mechanisms correspond approximately to peripheral seals in slant axis rotary mechanisms as is well known). In general, in trochoidal mechanisms, with respect to the end seals, high pressure will only exist on the apex seal side of the end seal, thus necessitating only the presence of the seal 64.

What is claimed is:

1. In a rotary mechanism having a housing defining an operating chamber and a rotor movable within the chamber, the combination of:

a piston seal receiving bore in said rotor;

a piston seal received in said bore to be carried by said rotor and sealingly engaging a wall of said operating chamber;

a first seal receiving groove in said rotor and intersecting said bore;

a correspondingly dimensioned first seal receiving groove in said piston seal and substantially centered with said first groove on said rotor;

a first seal received in said first seal receiving grooves;

a second seal receiving groove in said rotor and intersecting said bore at an angle to said first seal receiving groove in said rotor;

a second seal receiving groove in said piston seal only nominally centered with and substantially wider than said second seal receiving groove in said rotor;

a second seal received in said second seal receiving grooves; and a further seal received in said second seal receiving groove in said piston seal on one side of said second seal.

2. The rotary mechanism of claim 1 further including spring means for biasing at least some of said seals.

3. The rotary mechanism of claim 1 wherein there are two said further seals, one on each side of said second seal.

4. The rotary mechanism of claim 1 wherein said rotor has an apex and said first seal receiving groove in said rotor is disposed at said apex, said first seal being an apex seal.

* * * * *